US005794832A

United States Patent [19]

Chen

[11] Patent Number: 5,794,832

[45] Date of Patent: Aug. 18, 1998

[54] STAPLE MAGAZINE FOR A STAPLER

[76] Inventor: Tung-I Chen, P.O. Box 82-144, Taipei, Taiwan

[21] Appl. No.: 841,826

[22] Filed: May 6, 1997

[51] Int. Cl.[6] ..... B25C 5/16

[52] U.S. Cl. ..... 227/109; 227/119; 227/135

[58] Field of Search ..... 227/109, 119, 227/120, 135, 136

[56] References Cited

U.S. PATENT DOCUMENTS

| | | | |
|---|---|---|---|
| 2,716,749 | 9/1955 | Timmerbeil | 227/109 |
| 3,958,738 | 5/1976 | Tremblay | 227/109 |
| 4,552,296 | 11/1985 | Sheng | 227/109 |
| 4,556,161 | 12/1985 | Oide | 227/109 |
| 4,732,309 | 3/1988 | Judge | 227/109 |
| 5,695,108 | 12/1997 | Lee | 227/109 |

*Primary Examiner*—Scott A. Smith
*Attorney, Agent, or Firm*—A & J

[57] ABSTRACT

A staple magazine for a stapler includes an outer U-shaped frame, and an inner U-shaped frame mounted within the outer U-shaped frame thereby forming two grooves at two sides between the outer and inner U-shaped frames, characterized in that the inner U-shaped frame has two lateral side walls, a large rectangular stop plate and a small rectangular stop plate, the large and small rectangular stop plates being formed at a front end of the inner U-shaped frame and making an angle of 90 degrees with respect to the side walls, the stop plates being of different width and spaced apart by a vertical slot.

4 Claims, 6 Drawing Sheets

STAPLE MAGAZINE FOR A STAPLER

BACKGROUND OF THE INVENTION

1. Field of the Invention

This invention is related to a staple magazine for a stapler and in particular to one which can be adapted for use with various kinds of staples.

2. Description of the Prior Art

It has been found that the conventional staple magazine for a stapler is composed of an outer frame 100 and an inner frame 200 between which there is a groove 300 (see FIGS. 5, 6A and 6B). The inner frame 200 is formed with two lateral side walls 220 and a stop plate 240 at the front end for receiving I-shaped staples 500 and large inverted U-shaped staples 400. Nevertheless, such a magazine cannot receive small inverted U-shaped staples. Furthermore, the magazine cannot guide the staples smoothly and its stop plate 240 is easily deformed thereby deteriorating the stapling quality.

Therefore, it is an object of the present invention to provide an improved staple magazine for a stapler which can obviate and mitigate the above-mentioned drawbacks.

SUMMARY OF THE INVENTION

This invention is related to an improved staple magazine for a stapler.

It is the primary object of the present invention to provide an improved staple magazine for a stapler which can be adapted for use with inverted U-shaped, T-shaped, I-shaped and U-shaped staples.

It is another object of the present invention to provide an improved staple magazine for a stapling gun which can guide the staple smoothly.

It is still another object of the present invention to provide an improved staple magazine for a stapling gun which can ensure the stapling quality.

It is still another object of the present invention to provide an improved staple magazine for a stapling gun which is sturdy in construction.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

BRIEF DESCRIPTION OF THE DRAWINGS

The invention is further described hereafter, by way of example only, with reference to the accompanying drawings, in which.

DETAILED DESCRIPTION OF THE PREFERRED EMBODIMENT

Figure 1:
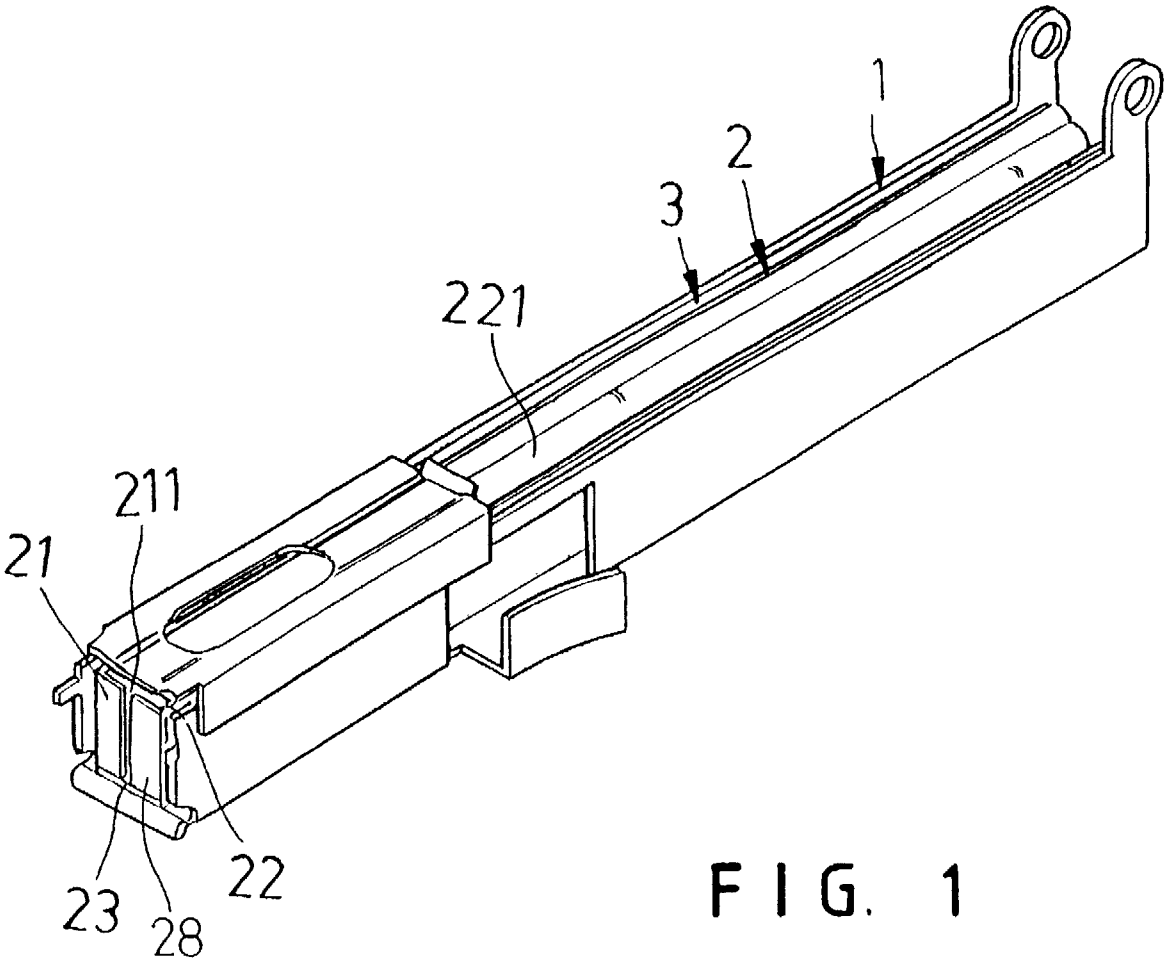
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2A:
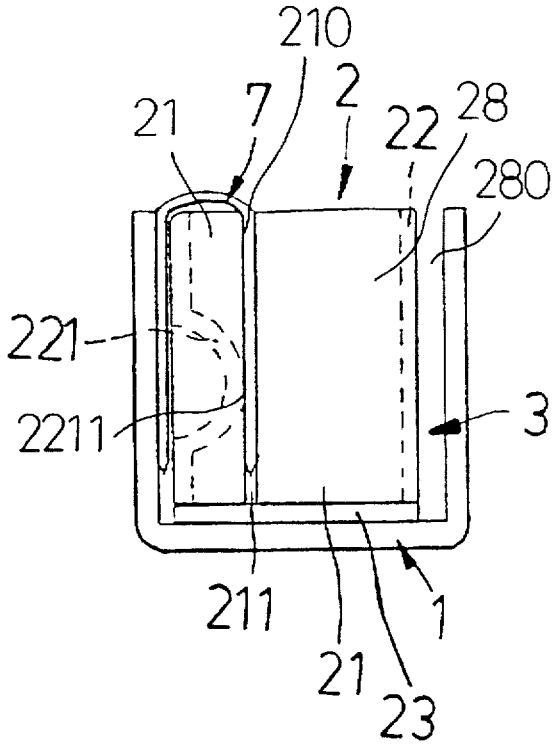
FIGS. 2A, 2B, 2C and 2D illustrate the working principle of the present invention.
Figure 2B:
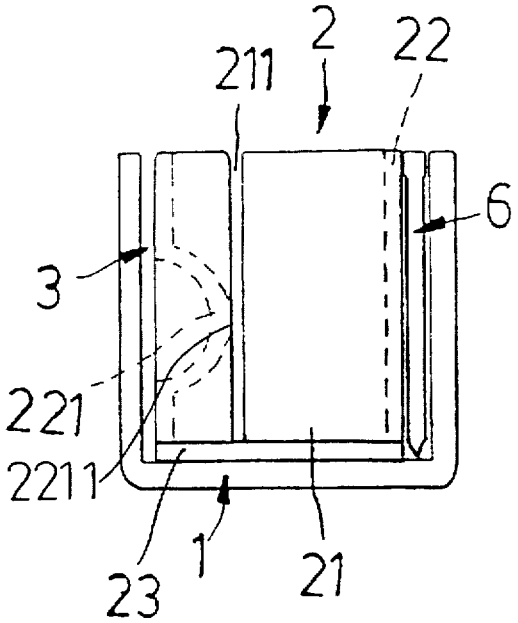
Figure 2C:
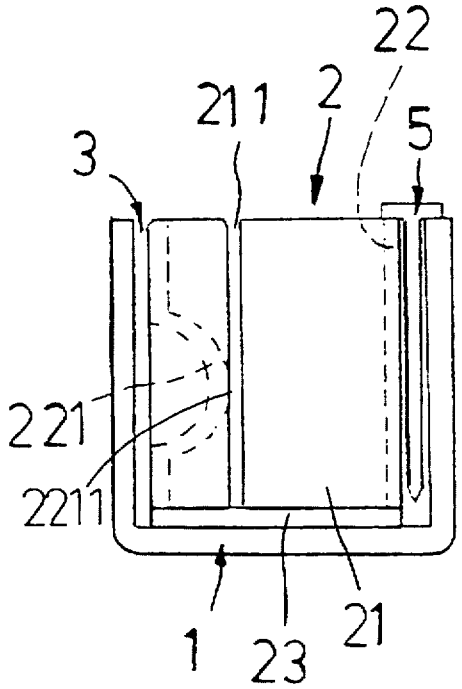
Figure 2D:
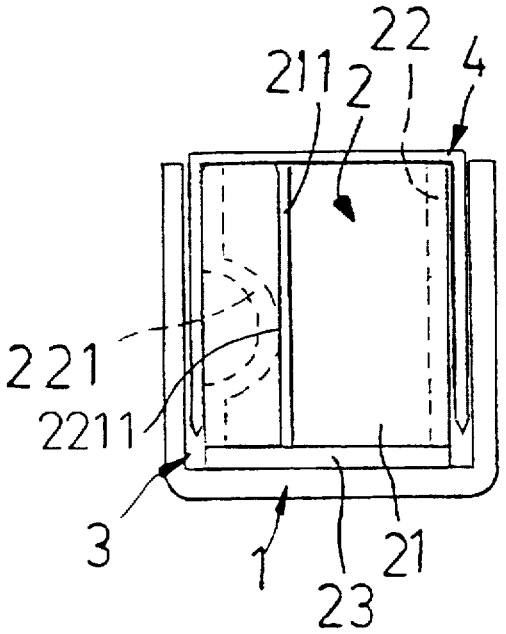

With reference to the drawings and in particular to FIGS. 1 and 2A thereof, the staple magazine for a stapler according to the present invention generally comprises an outer U-shaped frame 1 and an inner U-shaped frame 2 mounted within the outer U-shaped frame 1 thereby forming two grooves 280 at two sides between the outer and inner U-shaped frames 1 and 2.

As shown in FIGS. 1 and 2, the inner U-shaped frame 2 has two lateral side walls 22, a large rectangular stop plate 21 and a small rectangular stop plate 28. The large and small rectangular stop plates 21 are formed at the front end of the inner U-shaped frame 2 and integral with respective lateral side walls 22 and make an angle of 90 degrees with respect to the respective side walls 22. The two stop plates 21 and 28 are of different width and there is a vertical slot 211 therebetween. The lower edge of the stop plates 21 and 28 is just in contact with the upper side of the bottom 23 of the inner U-shaped frame 2 thereby reinforcing the stop plates 21 and 28.

The left lateral side wall 22 of the inner U-shaped frame 2 is formed with a longitudinal rail 221 which concaves inwards so that its back side 2211 is aligned with the inner vertical edge 210 of the small stop plate 21 for guiding staples (see FIGS. 2A, 2B, 2C and 2D). Hence, the small inverted U-shaped staple 7, the I-shaped staple 6, the T-shaped staple 5 and the large inverted U-shaped staple 4 can be conveniently fitted in the magazine according to the present invention, as shown in FIGS. 2A, 2B, 2C and 2D.

Figure 3:
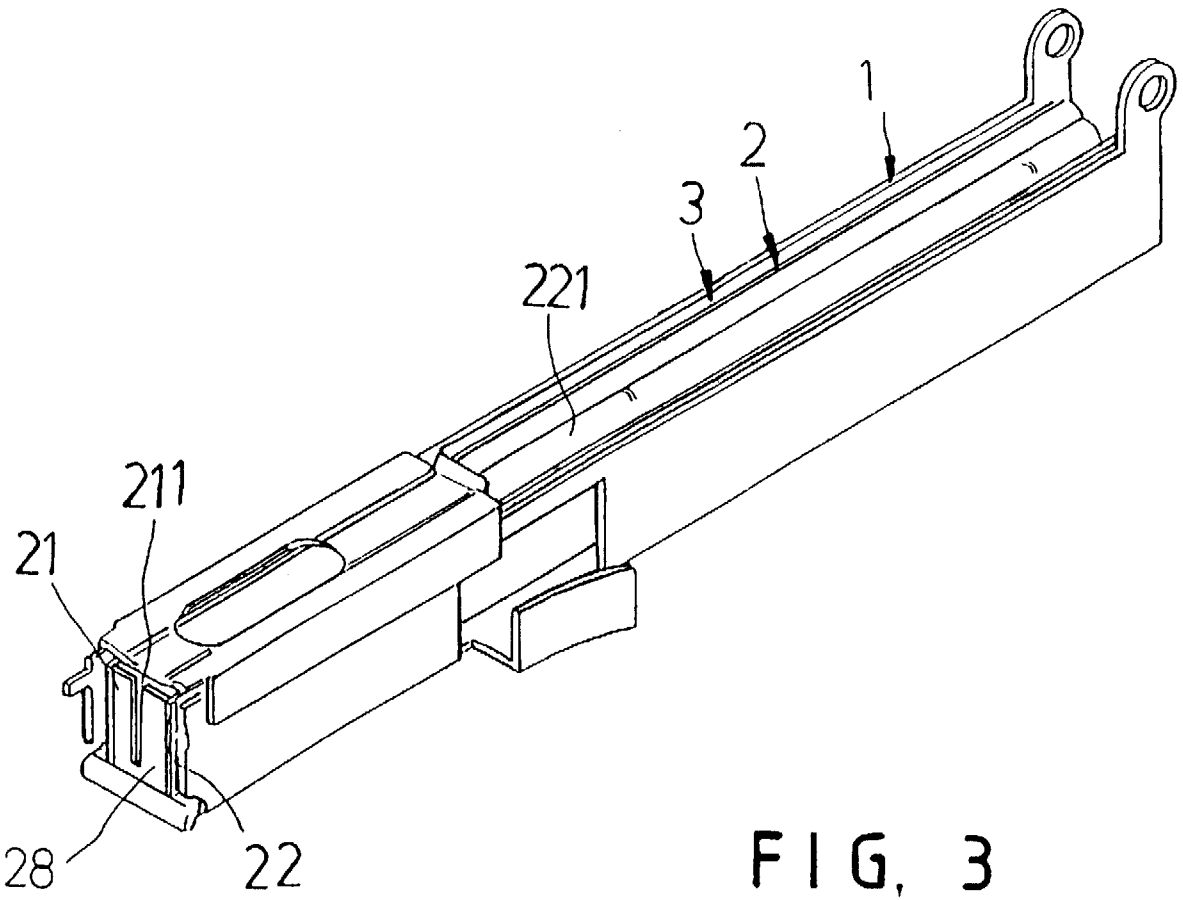
FIG. 3 illustrates a second preferred embodiment of the present invention.
Figure 4A:
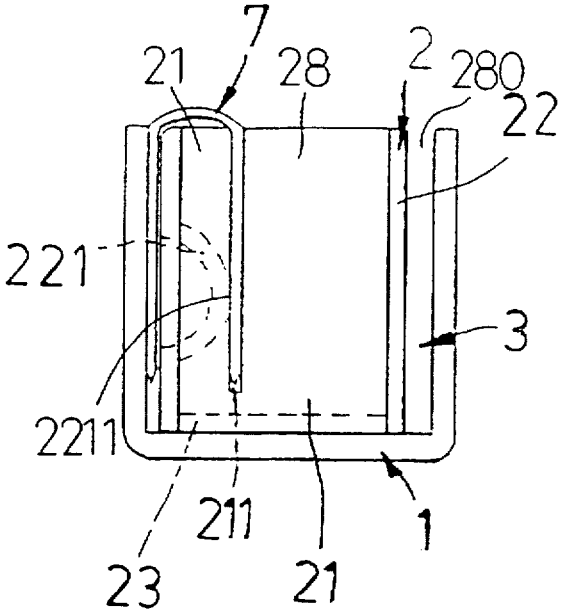
FIGS. 4A, 4B, 4C and 4D illustrate the working principle of the second preferred embodiment.
Figure 4B:
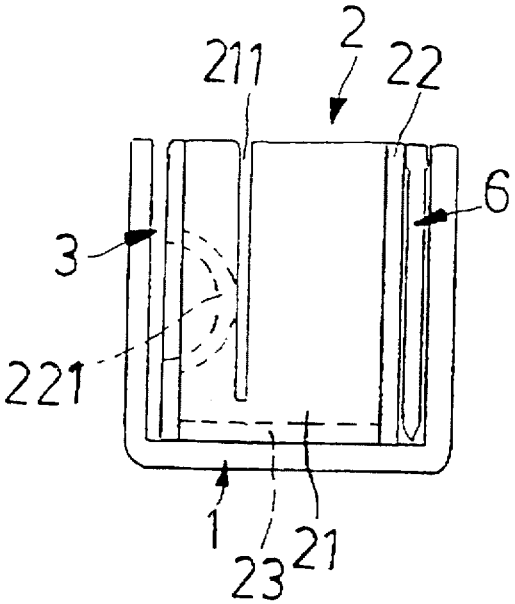
Figure 4C:
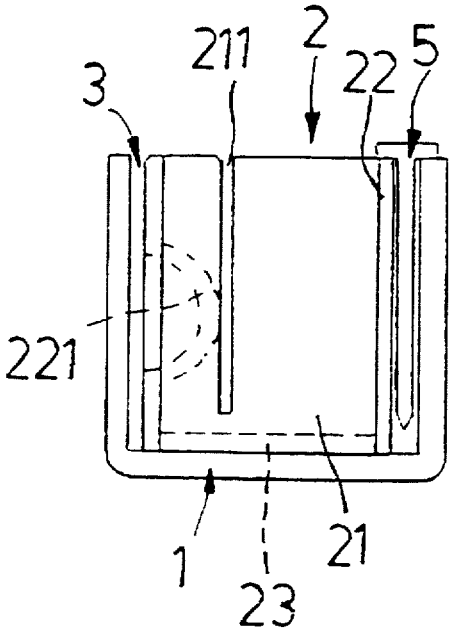
Figure 4D:
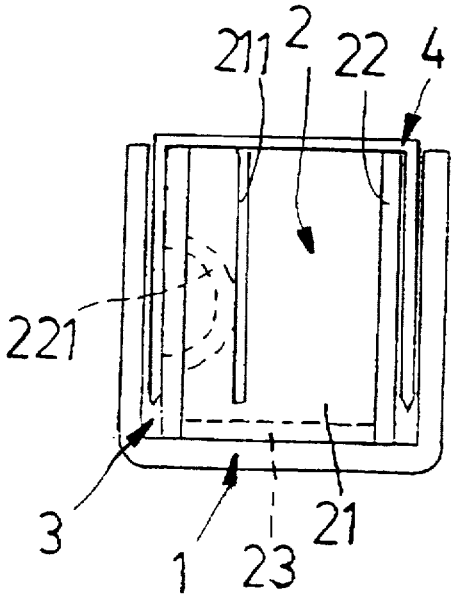
Figure 5:
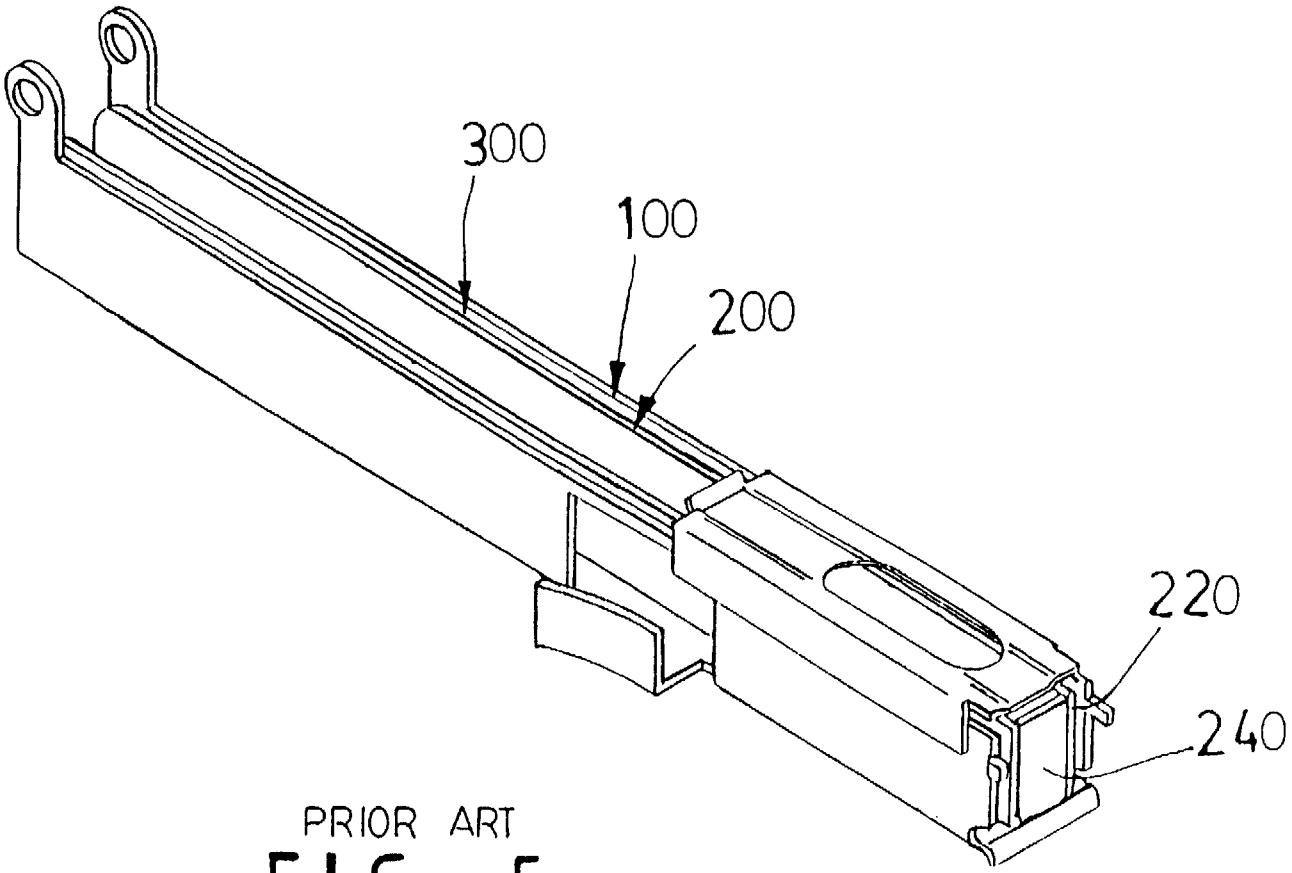
PRIOR ART FIG. 5
FIG. 5 is a perspective view of a prior art staple magazine for a stapler.
Figure 6A:
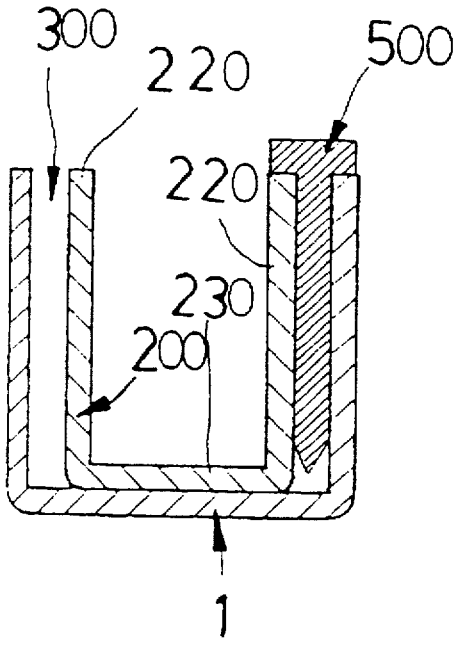
PRIOR ART FIG. 6A
FIGS. 6A and 6B illustrate the working principle of the prior art staple magazine shown in FIG. 5.
Figure 6B:
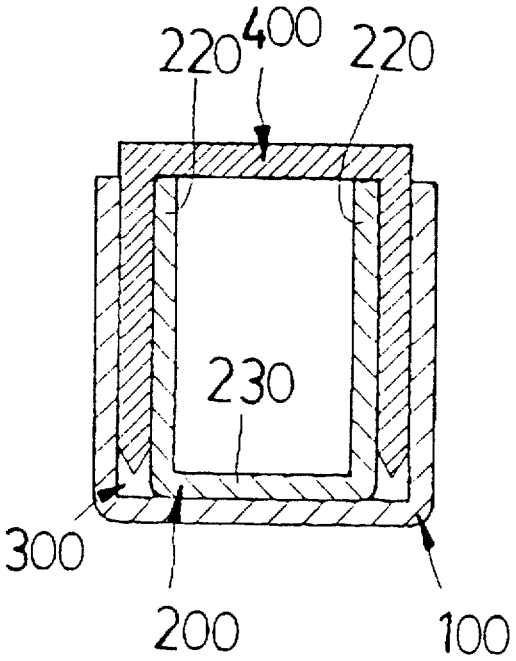
PRIOR ART FIG. 6B

FIG. 3 illustrates a second preferred embodiment of the present invention. As illustrated, the inner U-shaped frame 2 has two lateral side walls 22, a large rectangular stop plate 21 and a small rectangular stop plate 28. The large and small rectangular stop plates 21 are formed at the front end of the inner U-shaped frame 2 and integral with the bottom 23 of the inner U-shaped frame 2 and make an angle of 90 degrees with respect to the bottom 23. The two stop plates 21 and 28 are of different width and there is a vertical slot 211 therebetween. The left edge of the stop plate 21 and the right edge 28 of the stop plate 28 are just in contact with two lateral side walls 22 of the inner U-shaped frame 2 thereby reinforcing the stop plates 21 and 28.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A staple magazine for a stapler comprising:

an outer U-shaped frame; and an inner U-shaped frame mounted within said outer U-shaped frame thereby forming two grooves at two sides between said outer and inner U-shaped frames, said inner U-shaped frame having two lateral side walls, a large rectangular stop plate and a small rectangular stop plate, said large and small rectangular stop plates being formed at a front end of said inner U-shaped frame and making an angle of 90 degrees with respect to said side walls, said stop plates being of different width and spaced apart by a vertical slot.

2. The staple magazine for a stapler as claimed in claim 1, wherein said stop plates are integral with respective lateral side walls of said inner U-shaped frame and have a lower edge just in contact with a front side of a bottom of said inner U-shaped frame.

3. The staple magazine for a stapler as claimed in claim 1, wherein said stop plates are integral with a bottom of said inner U-shaped frame and have two outer edges just in contact with said two lateral side walls of said inner U-shaped frame.

4. The staple magazine for a stapler as claimed in claim 1, wherein said inner U-shaped frame has a lateral side wall formed with a longitudinal rail which concaves inwards to form a back side aligned with an inner vertical edge of said small rectangular stop plate.

* * * * *